US009661957B2

(12) United States Patent
Bamert

(10) Patent No.: US 9,661,957 B2
(45) Date of Patent: May 30, 2017

(54) SEAT AND STORAGE UNIT FOR A BATHTUB

(71) Applicant: Clinton Bamert, Guthrie, OK (US)

(72) Inventor: Clinton Bamert, Guthrie, OK (US)

( * ) Notice: Subject to any disclaimer, the term of this patent is extended or adjusted under 35 U.S.C. 154(b) by 33 days.

(21) Appl. No.: 14/622,509

(22) Filed: Feb. 13, 2015

(65) Prior Publication Data

US 2016/0235254 A1 Aug. 18, 2016

(51) Int. Cl.

| | |
|---|---|
| ***A47K 3/08*** | (2006.01) |
| ***A47K 3/12*** | (2006.01) |
| ***A47K 3/00*** | (2006.01) |
| ***A47B 88/60*** | (2017.01) |
| *A47K 3/14* | (2006.01) |

(52) U.S. Cl.

CPC ..... *A47K 3/122* (2013.01); *A47B 88/60* (2017.01); *A47K 3/001* (2013.01); *A47K 3/14* (2013.01)

(58) Field of Classification Search

USPC ..... 4/578.1, 549

See application file for complete search history.

(56) References Cited

U.S. PATENT DOCUMENTS

| | | | | |
|---|---|---|---|---|
| 2,151,581 A | | 3/1939 | Bentz | |
| 2,237,076 A | | 4/1941 | Kenney et al. | |
| 2,588,562 A | | 3/1952 | Parish | |
| 3,113,323 A | * | 12/1963 | Beardsley | A47K 3/02 4/549 |
| 3,584,320 A | | 6/1971 | Locke | |
| 3,955,221 A | * | 5/1976 | Finch | A47K 3/006 4/539 |
| 4,656,678 A | | 4/1987 | Lipski | |
| 4,955,093 A | | 9/1990 | Klassen | |
| 4,975,991 A | | 12/1990 | Peterson | |
| 5,090,068 A | * | 2/1992 | Zellner | A47K 3/122 4/578.1 |
| 5,551,100 A | | 9/1996 | Kindrick | |
| 5,606,751 A | | 3/1997 | Baker | |
| 6,094,756 A | | 8/2000 | Carter | |
| 6,134,723 A | | 10/2000 | Benson | |
| D452,056 S | | 12/2001 | Rosania | |
| 8,171,577 B1 | | 5/2012 | Gutt | |
| 8,516,627 B2 | | 8/2013 | Corcoran | |
| 2011/0107511 A1 | | 5/2011 | Alcala et al. | |

* cited by examiner

*Primary Examiner* — Lauren Crane

(74) *Attorney, Agent, or Firm* — Dunlap Codding, P.C.

(57) ABSTRACT

A seat and storage unit for a bathtub includes a platform, a support panel and at least one drawer supported by the support panel. The support panel extends from the platform in a substantially perpendicular relationship thereto a distance from a rear end of the platform and with a first side and a second side of the support panel spaced inwardly relative to a first side and a second side of the platform to cooperate with the platform to define a first wall receiving notch and a second wall receiving notch such that a portion of a bottom surface of the platform is positioned on the top end of the sidewalls of the bathtub when the support panel is positioned between the sidewalls of the bathtub.

12 Claims, 4 Drawing Sheets

SEAT AND STORAGE UNIT FOR A BATHTUB

BACKGROUND

Bathtub seats are widely used for babies, the elderly, the disabled, and other individuals for a convenient and safe place to sit while showering. A problem experienced with the use of bathtub seats, however, is the relatively large amount of space that such seats require. Another problem is the inability to store bath and shower supplies and easily access such supplies. Numerous bathtub chairs have been proposed in an attempt to maximize space available in a bathtub and to improve utility of the chairs, but none have addressed storage issues.

Although many of the prior art bathtub seats have achieved varying degrees of success, problems have nevertheless been experienced with the use of such bathtub seats. For example, to maximize the space of a bathtub by using a bathtub seat that folds up, the bathtub must usually be altered structurally in some manner to accommodate the seat. Such alterations usually involve drilling holes through the bathtub walls for bolts which are utilized to secure the bathtub seat to the bathtub whereby the seat is permanently fixed to the bathtub.

While connecting the bathtub seat to the bathtub in this manner ensures the seat is secured to the bathtub and takes up little space when folded up, there are situations in which it would be desirable to be able to remove the seat completely. Further, this type of bathtub seat does not allow the user to easily access bath and shower supplies while in the seated position.

Another known bathtub seat involves use of a removable platform seat mounted onto the top of side walls of a bathtub. Although this reference addresses the problem of removability, it does not address the functionality problem of the bathtub seat that is seen in prior art.

To this end, an improved bathtub seat has long been needed which provides functionality and which is quickly and easily installed in and removed from a bathtub. It is to such an improved bathtub seat that the present inventive concepts are directed.

DETAILED DESCRIPTION OF EXEMPLARY EMBODIMENTS

Figure 1:
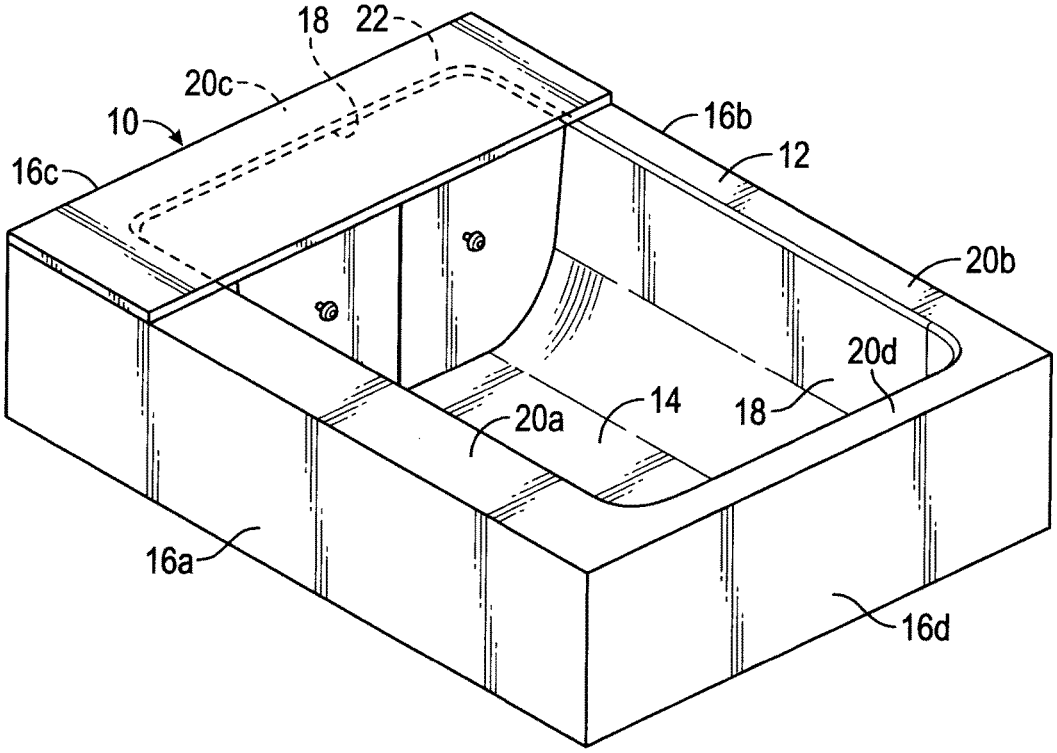
FIG. 1 is a perspective view of a seat and storage unit constructed in accordance with the inventive concepts disclosed herein shown mounted in a bathtub.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. The inventive concepts disclosed herein are capable of other embodiments, or of being practiced or carried out in various ways. Also, it is to be understood that the phraseology and terminology employed herein is for the purpose of description and should not be regarded as limiting the inventive concepts disclosed and claimed herein in any way.

In the following detailed description of embodiments of the inventive concepts, numerous specific details are set forth in order to provide a more thorough understanding of the inventive concepts. However, it will be apparent to one of ordinary skill in the art that the inventive concepts within the instant disclosure may be practiced without these specific details. In other instances, well-known features have not been described in detail to avoid unnecessarily complicating the instant disclosure.

As used herein, the terms "comprises," "comprising," "includes," "including," "has," "having," and any variations thereof, are intended to cover a non-exclusive inclusion. For example, a process, method, article, or apparatus that comprises a list of elements is not necessarily limited to only those elements, and may include other elements not expressly listed or inherently present therein.

Unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B is true (or present).

In addition, use of the "a" or "an" are employed to describe elements and components of the embodiments disclosed herein. This is done merely for convenience and to give a general sense of the inventive concepts. This description should be read to include one or at least one and the singular also includes the plural unless it is obvious that it is meant otherwise.

As used herein, qualifiers like "substantially," "about," "approximately," and combinations and variations thereof, are intended to include not only the exact amount or value that they qualify, but also some slight deviations therefrom, which may be due to manufacturing tolerances, measurement error, wear and tear, stresses exerted on various parts, and combinations thereof, for example.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Referring now to the drawings, and in particular to FIG. 1, a seat and storage unit 10 constructed in accordance with the inventive concepts disclosed herein is shown installed in a bathtub 12. The bathtub 12 is illustrated as being a conventional bathtub/shower combination having a bottom 14 disposed between a plurality of sidewalls 16*a*, 16*b*, 16*c*, 16*d*. The bottom 14 and the sidewalls 16*a*-16*d* cooperate to define a cavity 18. Each of the sidewall 16*a*-16*d* has a top end 20*a*-20*d*, respectively, forming a ledge 22.

Figure 4A:
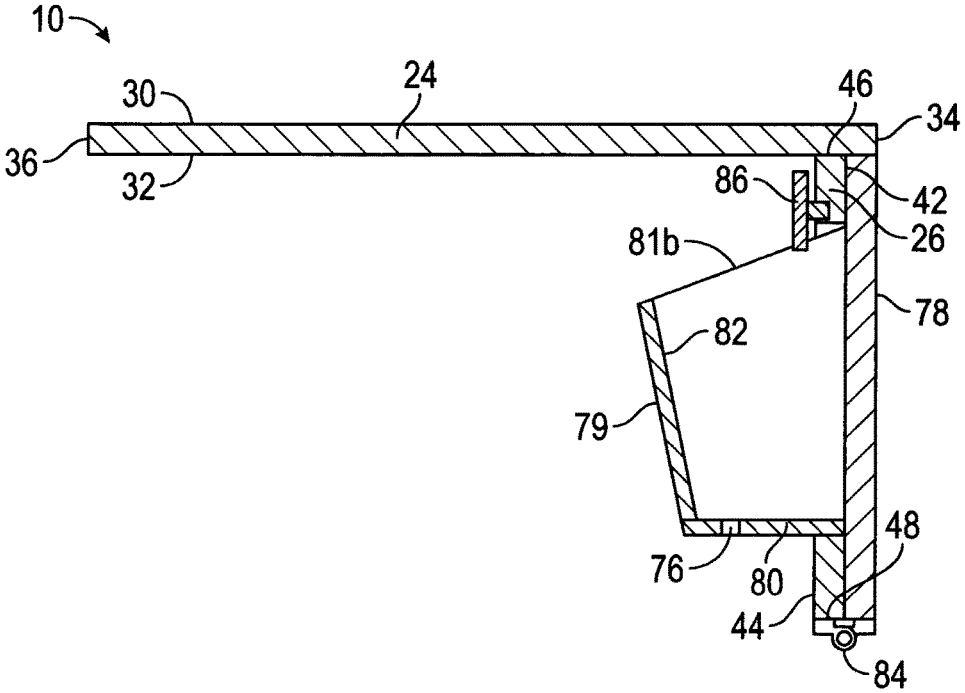
FIG. 4A is a sectional view taken along line 4A-4A of FIG. 2 illustrating a drawer in a closed position.
Figure 4B:
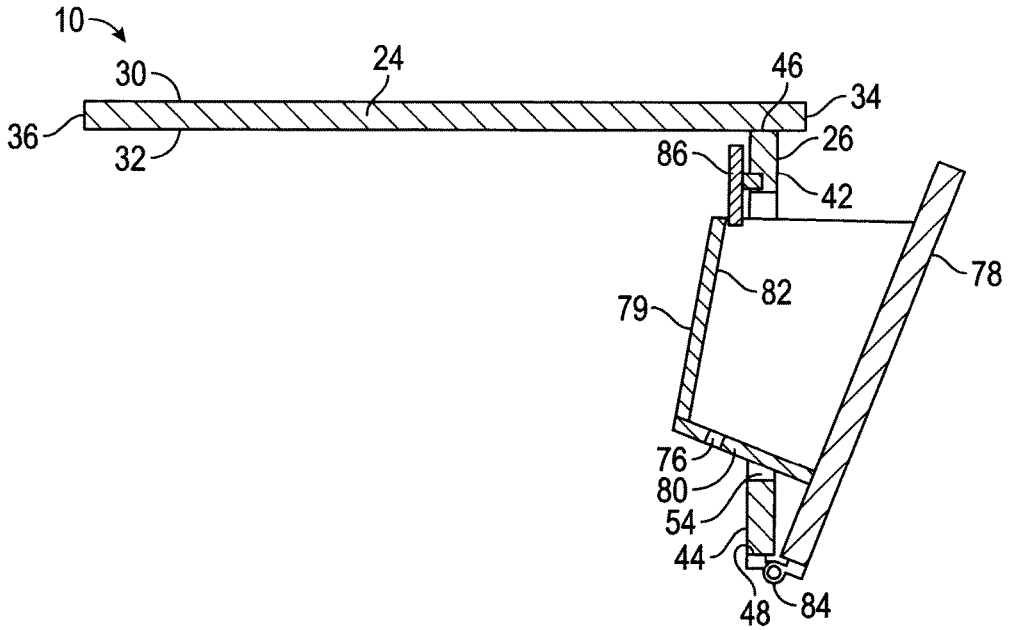
FIG. 4B is a sectional view taken along line 4A-4A of FIG. 2 illustrating the drawer in an open position.
Figure 4C:
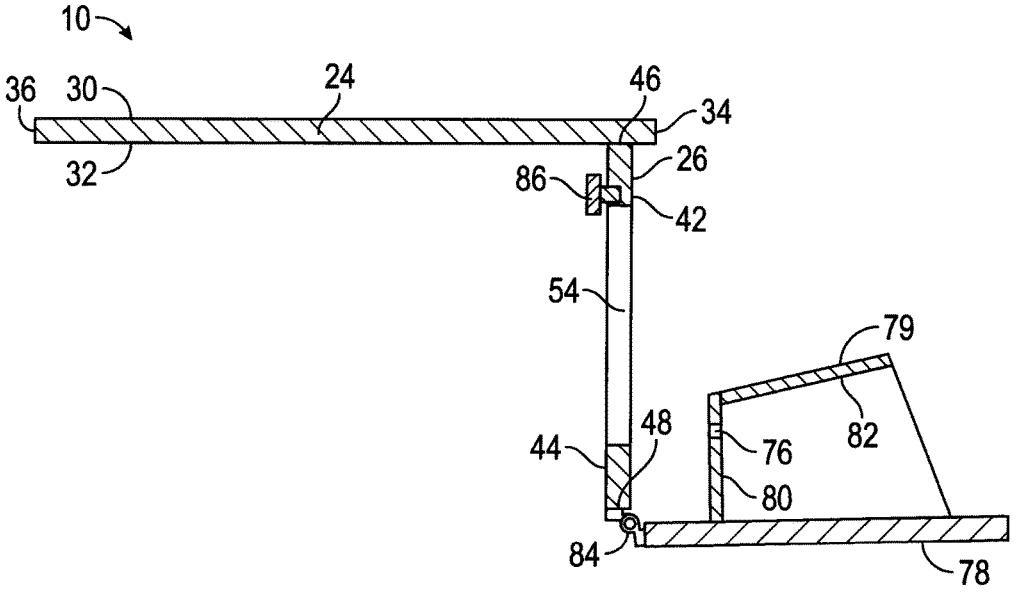
FIG. 4C is a sectional view taken along line 4A-4A of FIG. 2 illustrating the drawer in a mounting position.

Broadly, the seat and storage unit 10 includes a platform 24, a support panel 26 extending from the platform 24, and a pair of drawers 28*a* and 28*b* supported by the support panel 26 so as to be moveable between a closed position (FIGS. 1, 2, and 4A), an open position (FIG. 4B), and a mounting position (FIG. 4C).

The platform 24 is shown to be generally rectangular in shape, but the platform 24 may configured in a variety of shapes. The platform 24 includes a top surface 30, a bottom surface 32, a front end 34, a rear end 36, a first side 38, and a second side 40. The platform 24 has length so that the platform 24 is positionable on the top end 20*a* of the sidewall 16*a*, the top end 20*b* of the sidewall 16*b*, and the top end 20*c* of the sidewall 16*c*.

Figure 5:
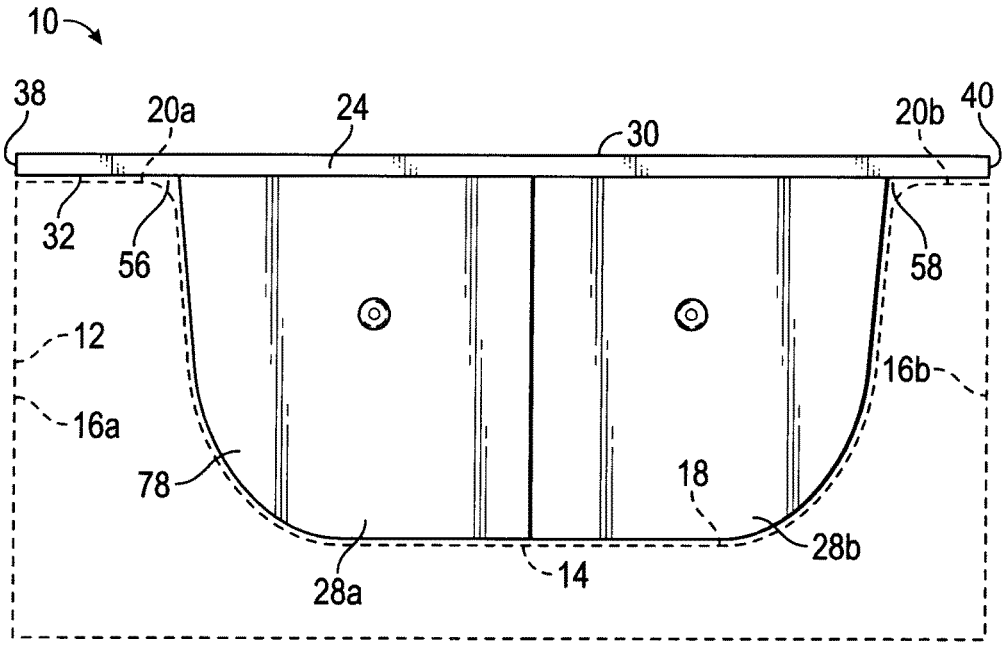
FIG. 5 is a front elevation view of the seat and storage unit.

The support panel 26 has a front face 42, a rear face 44, an upper end 46, a lower end 48, a first side 50, and a second side 52. In one embodiment, the support panel 26 has two drawer receiving openings 54 (FIG. 4B). However, the number of drawer receiving openings may be varied. In one embodiment, the support panel 26 extends downwardly from the platform 24 in a substantially perpendicular relationship to the platform 24 a distance from the rear end 36 of the platform 24. In one embodiment, the support panel 26 extends from the front end 34 of the platform 24. The support panel 26 is dimensioned so that the first side 50 and the second side 52 of the support panel 26 are spaced inwardly relative to the first side 38 and the second side 40, respectively, of the platform 24 to cooperate with the platform 24 to define a first wall receiving notch 56 and a second wall receiving notch 58 such that a portion of the bottom surface 32 of the platform 24 is positioned on the top ends 20*a*-20*c* of the sidewalls 16*a*-16*c* of the bathtub 12 when the support panel 26 is positioned in the cavity 18 of the bathtub 12 between the sidewalls 16*a*-16*d* of the bathtub 12. As best illustrated in FIG. 5, the first wall receiving notch 56 and a second wall receiving notch 58 may be formed to have widths of different sizes to accommodate sidewalls of different sizes. For example, some bathtubs may have sidewalls of different widths as illustrated in FIG. In another embodiment, the first wall receiving notch 56 and the second wall receiving notch 58 may be formed to have the same dimensions. The portion of the bottom surface 32 to be positioned on the top ends 20*a*-20*c* may be lined with, or otherwise provided with, a suitable non-skid material.

Figure 3:
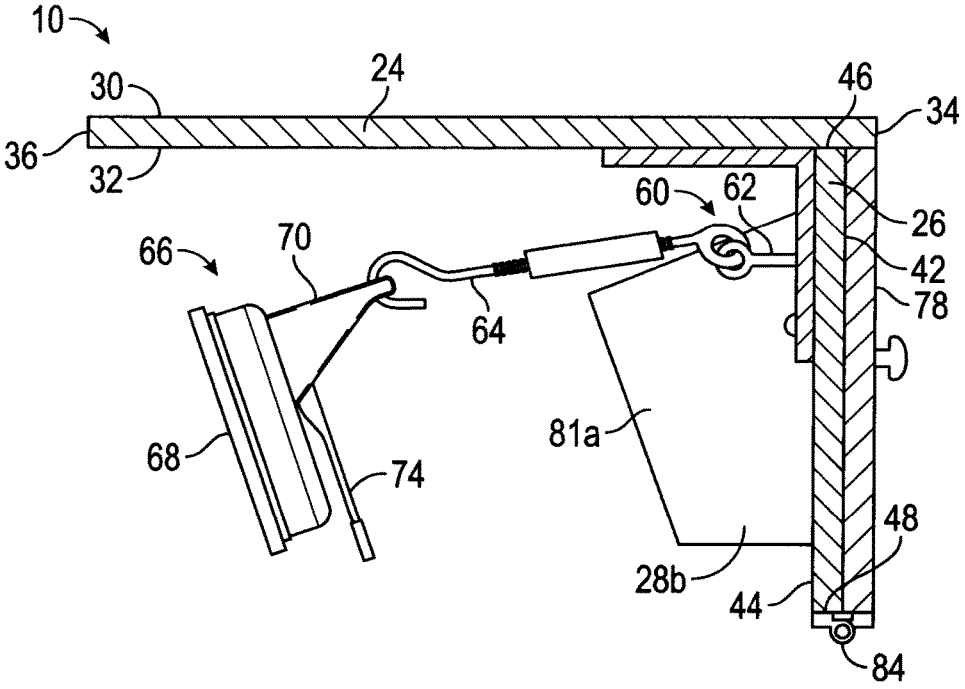
FIG. 3 is a sectional view taken along line 3-3 of FIG. 2.

Referring now to FIG. 3, the seat and storage unit 10 may include a mounting assembly 60 for securing the seat and storage unit 10 to the bathtub 12. The mounting assembly 60 may include a connecting member 62, a connecting rod 64, and a suction cup assembly 66 provided with a suction cup 68. In one embodiment, the connecting member 62 extends from the rear face 44 of the support panel 26 to provide an anchor point. If the seat and storage unit 10 includes two drawers 28, the connecting member 62 may be fastened to the support panel 26 between the drawer receiving openings 54. In other embodiments, the connecting member 62 may extend from the bottom surface 32 of the platform 24 or from the corner defined by the intersection of the platform 24 and the support panel 26.

The connecting rod 64 has a first end pivotally connected to connecting member 62 and a second end pivotally connectable to the suction cup assembly 66. The connecting rod 64 may be adjustable in a way that the length of the connecting rod 64 may be altered. By way of example, the connecting rod 64 may be turnbuckle, or other suitable tension creating devices.

The suction cup assembly 66 is connected to the second end of the connecting rod 64 in a way that the suction cup assembly 66 is selectively attachable to one of the sidewalls 16*a*-16*d* of the bathtub 12. The suction cup assembly 66 may be any suitable suction cup assembly that is capable of securing the seat and storage unit 10 to one or more of the sidewalls 16*a*-16*d* of the bathtub 12. The suction cup assembly 66 may include a base 70, the suction cup 68 supported by the base 70, and a handle 74 for actuating the suction cup 68 between a release position and a holding position. In another embodiment, a suction cup assembly may include only a suction cup.

Referring now to FIGS. 4A and 4B, the drawers 28*a* and 28*b* may be of any suitable construction so long as the drawers 28*a* and 28*b* are cable of providing storage. In one embodiment, the drawers 28*a* and 28*b* are substantially identical in design and construction except for their right and left hand characteristics. Thus, only the drawer 28*b* will be described in detail below. The drawer 28*b* is disposed in the drawer receiving opening 54 so as to be movable between a closed position (FIG. 4A), an open position (FIG. 4B), and a mounting position (FIG. 4C). The drawer 28*b* may contain a drain hole 76 to allow water that enters the drawer 28*b* to drain out to the bathtub 12. However, it will be appreciated by those of ordinary skill in the art that the interior of the drawer 28*b* may be designed and constructed in various ways to facilitate liquid drainage, or other features, such as luffa pegs or soap trays.

In one embodiment, the drawer 28*b* includes a front panel 78, a pair of side panels 81*a* and 81*b*, a rear panel 79, and a bottom panel 80 cooperating to define a drawer compartment 82. The front panel 78 has a lower end hingedly connected to the support panel 26 with a hinge 84 to permit the drawer 28*b* to be moved between the closed position, the open position, and the mounting position. The drawer 28*b* may be supported in the open position by a tab 86 that is rotatably connected to the rear face 44 of the support panel 26 so as to be positionable between a support position (FIGS. 4A and 4B) wherein a portion of the tab 86 extends into the drawer receiving opening 54 to contact and support the rear panel 79 of the drawer and a non-support position (FIG. 4C) wherein the tab 86 is removed from the drawer receiving opening 54 so that the drawer 28*b* may be substantially removed from the drawer receiving opening 54. With the drawer 28*b* in the mounting position, a user has access to the mounting assembly 60 to facilitate mounting of the seat and storage unit 10 to and removal of the seat and storage unit 10 from the bathtub 12.

Figure 2:
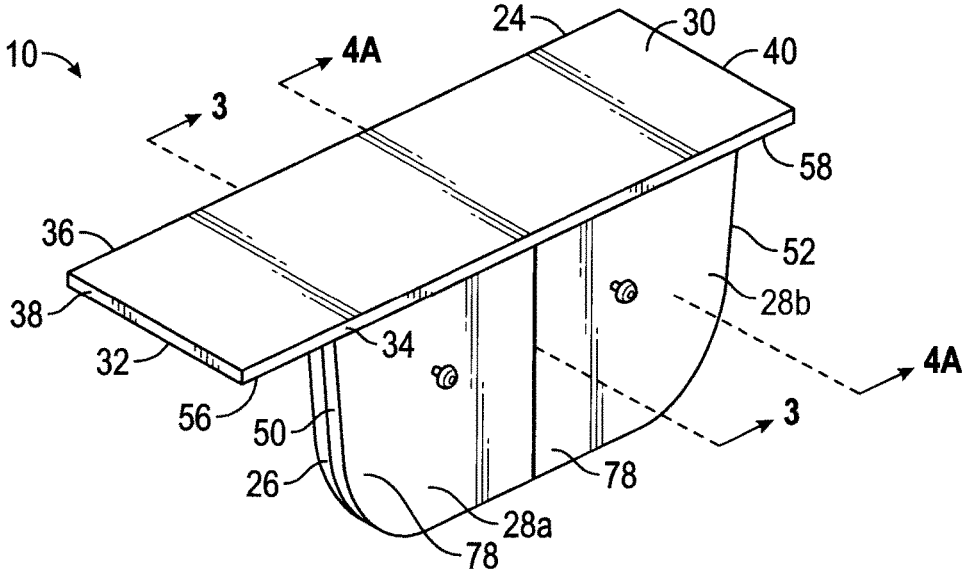
FIG. 2 is a perspective view of the seat and storage unit of FIG. 1.

As shown in FIGS. 2 and 5, the support panel 26 and the front panels 78 of the drawers 28*a* and 28*b* may be sized and shaped to substantially conform to the contour of the sidewalls 16*a*-16*d* and the bottom 14 of the bathtub 12 to maximize the space underneath the platform 24. Furthermore, with such design, the drawers 28*a* and 28*b* are more accessible from a seated position on the platform 24.

The support panel 26 and the front panels 78 of the drawers 28*a* and 28*b* are shown to be sized and shaped to substantially conform to the contour of the sidewalls 16*a*-16*d* and bottom 14 of the bathtub 12, but the support panel 26 and the front panels 78 of the drawers 28*a* and 28*b* may configured in a variety of sizes and shapes. For example, the support panel 26 and the front panels 78 of the drawers 28*a* and 28*b* may be spaced farther inwardly relative to the sidewalls 16*a*-16*d* and the bottom 14 of the bathtub 12. It will also be appreciated by those of ordinary skill in the art that the number of drawers may be varied. For example, the seat and storage unit 10 may contain one, two, three, or four drawers.

Figure 6:
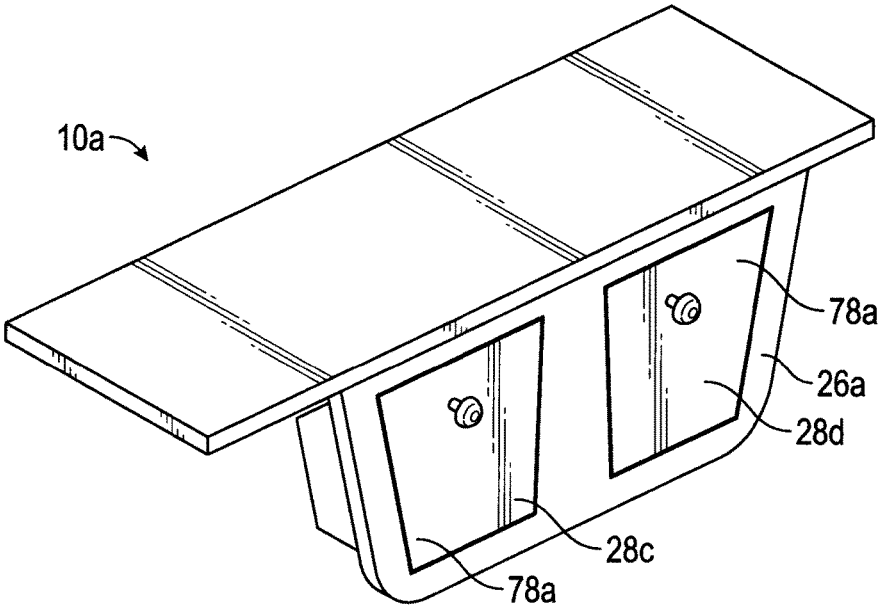
FIG. 6 is a perspective view of another embodiment of a seat and storage unit constructed in accordance with the inventive concepts disclosed herein.

Referring now to FIG. 6, another embodiment of a seat and storage unit 10*a* is illustrated. The seat and storage unit 10*a* is similar to the seat and storage unit 10 described above except the seat and storage unit 10*a* drawers 28*c* and 28*d*.

Each of the drawers 28*c* and 28*d* has a front panel 78*a* that is flush with a support panel 26*a* when the drawers 28*c* and 28*d* are in the closed position. In addition, each of the drawers 28*c* and 28*d* is hinged to the support panel 26*a* with a hinge (not shown).

The components of the seat and storage units 10 and 10*a* may be formed of any suitable polymeric material or any other suitable waterproof or water resistant material. The components may be interconnected in a suitable fashion to provide a unitary body which may be installed into and removed from the bathtub 12 as a single unit or as multiple components.

As indicated above, the seat and storage units 10 and 10*a* may be secured to the bathtub 12 with the mounting assembly 60. The use of the mounting assembly 60 permits the seat and storage unit 10 to be quickly and easily mounted to the bathtub 12 and removed therefrom without requiring the bathtub 12 to be structurally altered. The mounting assembly 60 can be adjusted and when the desired position is achieved, the mounting assembly 60 may be tensioned or loosened by adjusting the length of the connecting rod 64. With the seat and storage units 10 and 10*a* secured to the bathtub 12, a bather may sit upon the platform 24 of the seat and storage units 10 and 10*a*.

From the above description, it is clear that the inventive concepts disclosed herein are well adapted to carry out the objects and to attain the advantages mentioned herein as well as those inherent in the inventive concepts disclosed herein. While exemplary embodiments of the inventive concepts disclosed herein have been described for purposes of this disclosure, it will be understood that numerous changes may be made which will readily suggest themselves to those skilled in the art and which are accomplished within the scope of the inventive concepts disclosed and as defined in the appended claims.

What is claimed is:

1. A storage unit for a bathtub having a bottom and a plurality of sidewalls, each sidewall having a top end, the storage unit comprising:

a platform having a top surface, a bottom surface, a front end, a rear end, a first side, and a second side;

a support plate having a front face, a rear face, an upper end, a lower end, a first side, and a second side, the support plate extending from the platform in a substantially perpendicular relationship thereto a distance from the rear end of the platform and with the first side and the second side of the support plate spaced inwardly relative to the first side and the second side of the platform to cooperate with the bottom surface of the platform to form a first wall receiving notch and a second wall receiving notch such that a portion of the bottom surface of the platform is positioned on the top end of the sidewalls of the bathtub when the support plate is positioned between the sidewalls of the bathtub, the support plate having at least one drawer receiving opening formed there through such that the drawer receiving opening is positioned below the portion of the bottom surface of the platform forming the first and second wall receiving notches; and a drawer disposed in the drawer receiving opening so as to be moveable between a closed position and an open position.

2. The storage unit of claim 1, further comprising a mounting assembly extending from at least one of the rear face of the support plate and the lower surface of the platform, the mounting assembly including a suction cup.

3. The storage unit of claim 2, wherein the support plate has at least two drawer receiving openings, and wherein the storage unit further has at least two drawers disposed in the drawer receiving openings, and the drawer receiving openings being symmetrically arranged on the support plate.

4. The storage unit of claim 3, wherein the mounting assembly extends from the rear face of the support plate from a position located between the drawer receiving openings.

5. The seat and storage unit of claim 2, wherein the drawer is moveable to a mounting position wherein the drawer is removed from the drawer receiving opening in a way to provide access to the mounting assembly via the drawer receiving opening.

6. The seat and storage unit of claim 1, wherein the first wall receiving notch and the second wall receiving notch each have a width, and wherein the width of the first wall receiving notch is different than the width of the second wall receiving notch.

7. A seat and a storage unit in combination with a bathtub having a bottom and a plurality of sidewalls, each sidewall having a top end, the seat and storage unit comprising:

a platform having a top surface, a bottom surface, a front end, a rear end, a first side, and a second side;

a support plate having a front face, a rear face, an upper end, a lower end, a first side, and a second side, the support plate extending from the platform in a substantially perpendicular relationship thereto a distance from the rear end of the platform and with the first side and the second side of the support plate spaced inwardly relative to the first side and the second side of the platform to cooperate with the bottom surface of the platform to form a first wall receiving notch and a second wall receiving notch, the support panel positioned between the sidewalls of the bathtub and a portion of the bottom surface of the platform positioned on the top end of the sidewalls of the bathtub, the support plate having at least one drawer receiving opening formed there through such that the drawer receiving opening is positioned below the portion of the bottom surface of the platform forming the first and second wall receiving notches; and a drawer disposed in the drawer receiving opening so as to be moveable between a closed position and an open position.

8. The seat and storage unit of claim 7, further comprising a mounting assembly extending from at least one of the rear face of the support panel and the lower surface of the platform, the mounting assembly including a suction cup.

9. The seat and storage unit of claim 8, wherein the support panel has at least two drawer receiving openings, and wherein the seat and storage unit further has at least two drawers disposed in the drawer receiving openings, and the drawer receiving openings being symmetrically arranged on the support panel.

10. The seat and storage unit of claim 9, wherein the mounting assembly extends from the rear face of the support panel from a position located between the drawer receiving openings.

11. The seat and storage unit of claim 8, wherein the drawer is moveable to a mounting position wherein the drawer is removed from the drawer receiving opening in a way to provide access to the mounting assembly via the drawer receiving opening.

12. The seat and storage unit of claim 7, wherein the width of the first wall receiving notch is different than the width of the second wall receiving notch.

* * * * *